US005412817A

United States Patent [19]

Smith

[11] Patent Number: 5,412,817

[45] Date of Patent: May 9, 1995

[54] BATHING FIXTURE

[75] Inventor: Lee A. Smith, 3901 Foxcroft Rd., Charlotte, N.C. 28211

[73] Assignees: Kendrick S. Gaertner; Susannah S. Knight; Sarah Jane S. Plevka; Lee A. Smith, all of Charlotte, N.C.

[21] Appl. No.: 145,751

[22] Filed: Oct. 29, 1993

[51] Int. Cl.[6] ..... A47K 3/12

[52] U.S. Cl. ..... 4/578.1

[58] Field of Search ..... 4/571.1, 572.1, 573.1, 4/578.1, 579

[56] References Cited

U.S. PATENT DOCUMENTS

| | | | |
|---|---|---|---|
| 1,633,310 | 6/1927 | Bozarth . | |
| 1,740,444 | 12/1929 | Downham et al. . | |
| 2,112,662 | 3/1938 | Bentz . | |
| 2,236,927 | 4/1941 | Thomas | 4/579 |
| 2,852,785 | 9/1958 | Mikola . | |
| 3,086,221 | 4/1963 | Gass | 4/579 |
| 3,252,167 | 5/1966 | Eddy . | |
| 3,528,111 | 9/1970 | Chou | 4/572.1 |
| 4,034,425 | 7/1977 | Van Riemsdyck . | |
| 4,472,844 | 9/1984 | Mace . | |
| 4,881,281 | 11/1989 | Lavoine et al. | 4/572.1 |
| 5,090,068 | 2/1992 | Zellner | 4/578.1 |
| 5,097,542 | 3/1992 | Roesler . | |

FOREIGN PATENT DOCUMENTS 0273770 11/1989 Germany .

2014446 8/1979 United Kingdom .

OTHER PUBLICATIONS

Electric Mobility, "Introducing The Dignity Bath", 3 pages.

Guardian Products, Inc., "Deluxe Padded Transfer Benches/Commode with Tub Clamps", Model No. 98015, 1986, 1 page.

Frohock Stewart, Inc., Model 300, "Bathtub Safety Seat", 1 page.

Barrier Free Environments, Inc., "A Proposed Bathtub and Matching Removable Seat", Jan. 15, 1991, 4 pages.

Barrier Free Environments, Inc., "Proposed Accessory Tub Seat", Jan. 14, 1991, pp. 1–8.

*Primary Examiner*—Charles E. Phillips

[57] ABSTRACT

A bathing fixture is disclosed which includes a seat assembly having a horizontal support portion and an upright backrest portion joined thereto. The seat assembly further includes a downturned lip that overlies the front wall of the bathtub and a stabilizing bar that extends into and is supported by a receptacle in the back wall of the bathtub. Two elongate plungers are mounted to the bottom surface of the horizontal support portion and a pad is mounted on one end of both plungers. The elongate plungers permit selective movement of the pad so as to laterally engage the inner surface of the front wall of the bathtub and to firmly secure the seat assembly to the bathtub.

9 Claims, 4 Drawing Sheets

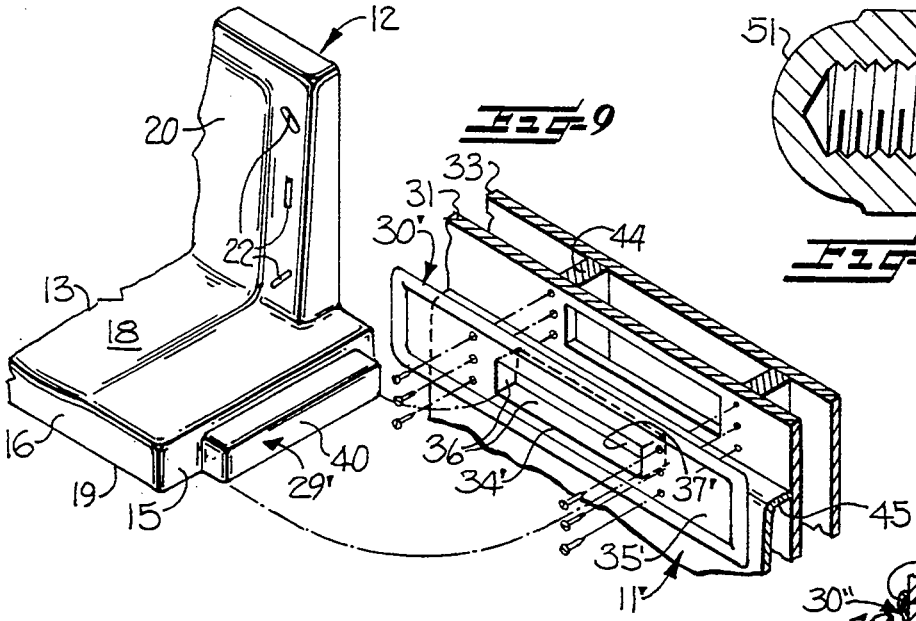
Fig-9
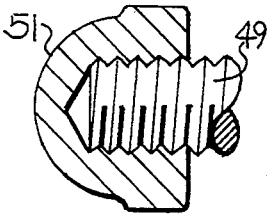
Fig-14
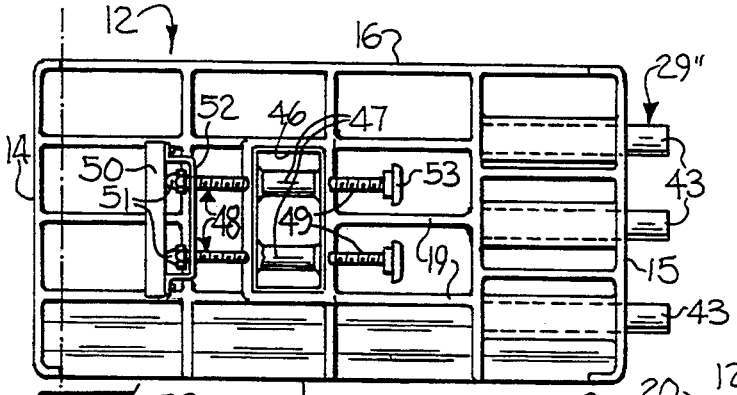
Fig-10
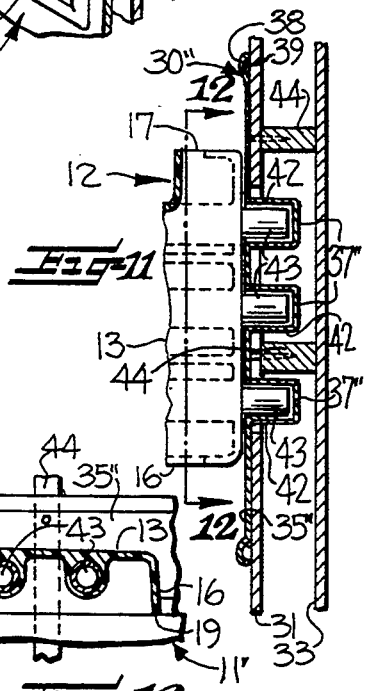
Fig-11
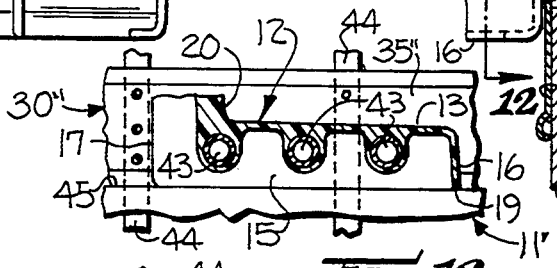
Fig-12
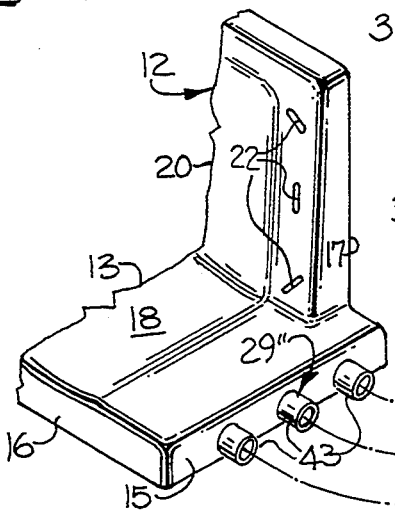
Fig-13
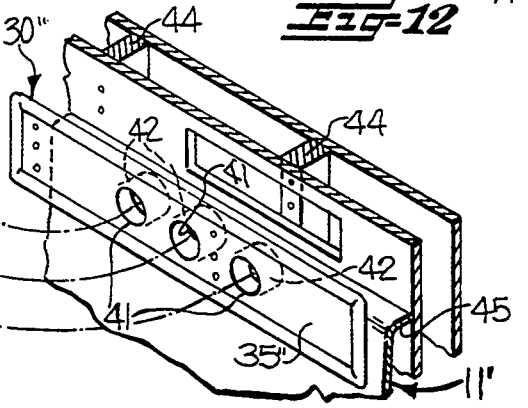

BATHING FIXTURE

FIELD OF THE INVENTION

The present invention relates to bathing fixtures and more particularly to bathtub seat assemblies for the handicapped or elderly.

BACKGROUND OF THE INVENTION

The present invention relates to bathing fixtures for mobility-impaired people, such as the handicapped or elderly. Mobility-impaired people often have difficulty taking showers or baths in traditional bathtubs. Taking a shower in a traditional bathtub requires that a person stand for a fairly substantial period of time, which may be difficult or impossible for the mobility-impaired. Similarly, getting into a traditional bathtub to take a bath requires that the user be able to step over the front wall of the bathtub and sit down on the bottom surface of the tub base. Getting out of the bathtub can be even more difficult. Recent government regulations, such as the Americans with Disabilities Act of 1990, have prompted the design of new bathing fixtures that make it easier for the disabled to bathe.

Several bathing fixture designs incorporating a bathtub seat are known in the prior art. For example, U.S. Pat. No. 5,097,542 to Roesler discloses a swiveling bathing chair that rests on the bottom surface of the bathtub. U.S. Pat. No. 4,472,844 to Mace discloses a tub shower seat that also rests on the bottom surface of the bathtub and which has an elaborate bracket mechanism for securing the seat to the front wall of the bathtub. U.S. Pat. No. 3,252,167 to Eddy discloses a bathtub safety seat that is mounted between the two inner walls of the bathtub. This seat, however, does not include a backrest and can only be mounted at the rear end of the bathtub, which is furthest away from the water controls.

It is accordingly an object of the present invention to provide a bathing fixture which overcomes the limitations of the prior art.

It is also an object of the present invention to provide a bathing fixture that is relatively light and easy to install.

It is also an object of the present invention to provide a secure and stable bathing fixture that can be installed at variable points along the length of the bathtub.

SUMMARY OF THE INVENTION

These and other objects and advantages of the present invention are achieved in the embodiments illustrated herein by the provision of a seat assembly which includes a horizontal support portion having opposite first and second side edges, opposite front and rear edges, an upper surface, and a bottom surface. A housing is mounted to the bottom surface of the seat assembly, and an elongate plunger means, which includes a pad means mounted to one end thereof, is mounted to the housing so that the plunger means extends in a lateral direction and is adjustable in the lateral direction. Thus the seat assembly may be mounted to a bathtub with the first side edge of the support portion resting upon the relatively low upper edge of the front wall of the bathtub, and with the pad means laterally engaging the front wall of the bathtub.

In a preferred embodiment, the seat assembly further includes a downturned lip connected along the first side edge and a stabilizing bar which extends from the second side edge in a lateral direction. When the seat assembly is installed in a bathtub, the first side edge of the support portion rests upon the upper edge of the front wall of the bathtub and the downturned lip overlies the outer surface of the front wall. The stabilizing bar may extend into and be supported by a receptacle which opens toward the front wall and which is disposed in the back wall of the bathtub at an elevation substantially corresponding to that of the upper edge of the front wall. In bathtubs without a receptacle, the stabilizing bar is supported by the upward facing surface which is present in the back wall of most conventional bathtubs at an elevation substantially corresponding to that of the upper edge of the front wall.

In the first preferred embodiment, the receptacle in the back wall of the bathtub includes an elongate continuous slot which extends along a longitudinal direction, extending between the front and rear edges of the support portion, and the stabilizing bar includes an elongate plate-like member which extends along a portion of the longitudinal length of the slot. In the second preferred embodiment, the receptacle includes a plurality of separate openings which extend along the longitudinal direction and the stabilizing bar includes a plurality of stud-like members which are positioned in the respective openings.

The seat assembly can be fastened to the bathtub by one or both of two engagements, depending on the width of the bathtub. In the first, the downturned lip engages the outer surface of the front wall so that the front wall of the bathtub is gripped between the lip and the pad on the end of the plungers. In the second, either the second side edge of the support portion or the stabilizing bar, depending on the depth of the receptacle and the length of the stabilizing bar, is held in engagement with a generally vertical abutment surface of the back wall or the receptacle, by the engagement of the pad with the inner surface of the front wall.

BRIEF DESCRIPTION OF THE DRAWINGS

Some of the objects and advantages of the present invention having been stated, others will appear as the description proceeds when taken in conjunction with the accompanying drawings, in which

FIG. 9 is an exploded view of the first embodiment of the receptacle and stabilizing bar;

FIG. 10 is a bottom view of the second embodiment of the seat assembly;

FIG. 11 is a sectioned view of the second embodiment of the stabilizing bar and receptacle illustrating a wall stud disposed between two of the openings of the receptacle;

FIG. 12 is a partially sectioned view of the second embodiment of the stabilizing bar as taken along line 12—12 of FIG. 11;

FIG. 13 is an exploded view of the second embodiment of the receptacle and stabilizing bar;

FIG. 14 is a sectioned view of the cap nut on one of the plungers;

DETAILED DESCRIPTION OF THE PREFERRED EMBODIMENTS

Figure 1:
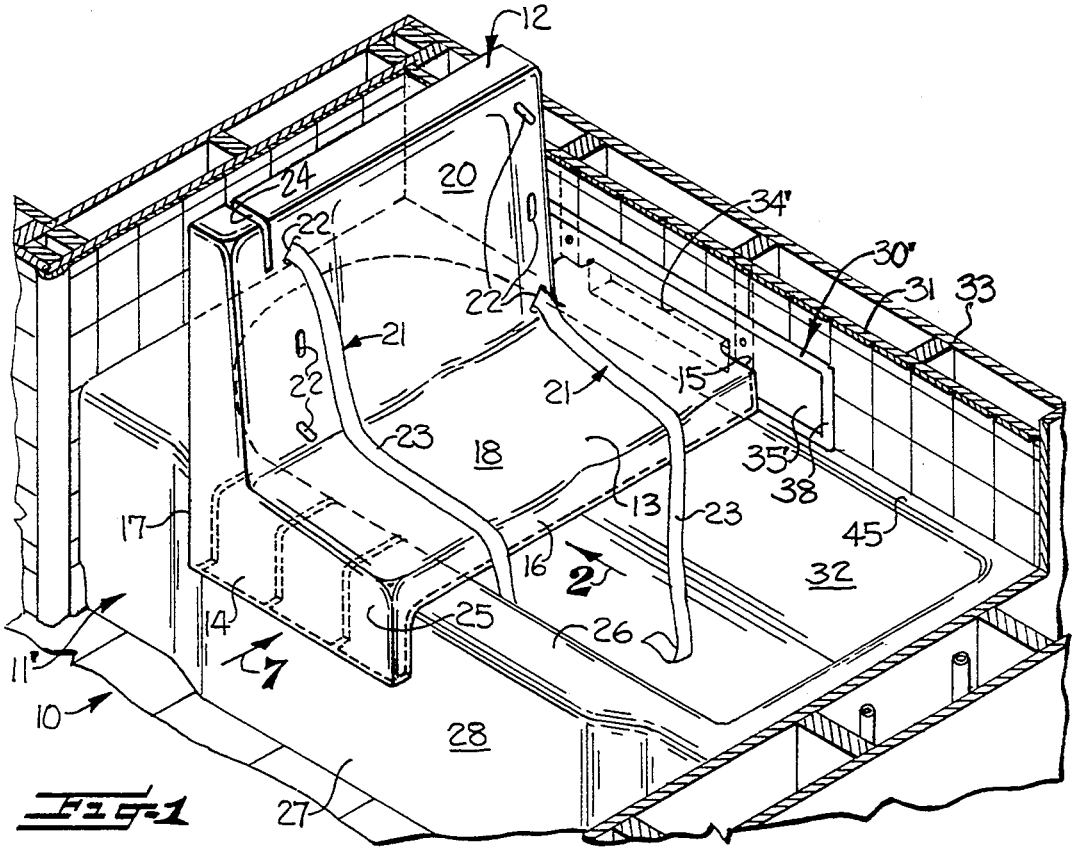
FIG. 1 is a perspective view of the bathing fixture of the present invention.

Referring more particularly to the drawings, FIG. 1 illustrates the bathing fixture 10 of the present invention. The bathing fixture 10 includes a bathtub 11′, 11″ and a seat assembly 12 for supporting the user while in the bathtub 11′, 11″. The seat assembly 12 is formed of a strong but non-corrosive material, such as plastic or acrylic, that may be treated to be nonflammable and resistant to fungus, bacteria and ultraviolet light. The seat assembly 12 has a horizontal support portion 13 of generally rectangular shape that includes opposite first 14 and second 15 side edges, opposite front 16 and rear 17 edges, an upper surface 18 and a bottom surface 19. The upper surface 18 of the horizontal support portion is contoured to accommodate the buttocks and legs of the user and is slightly sloped towards the front edge to allow water to run off.

An upright backrest portion 20 of generally rectangular shape is joined to the rear edge 17 of the horizontal support portion 13. The backrest portion 20 is reclined at a slight angle and is contoured to accommodate the back of the user. Belt means 21 is joined to the backrest portion 20 of the seat assembly 12 for fully supporting a user in a seated position. Three pairs of belt slots 22 are disposed in the backrest portion 20 and at least one belt 23 is looped through one belt slot 22, around the back of the backrest portion 20 and through an opposing belt slot 22. The belts 23 are made of a soft material and are fastened with a buckle (not shown). The backrest portion 20 further includes a curtain slot 24 for securing a shower curtain, as shown in phantom in FIGS. 15 and 16, to the seat assembly 12.

The seat assembly further includes a downturned lip 25 connected along the first side edge 14. When the seat assembly 12 is installed in the bathtub, the first side edge 14 of the support portion rests upon the upper edge 26 of the relatively low front wall 27 of the bathtub and the downturned lip 25 overlies the outer surface 28 of the front wall 27. A strip 55 of rubber or other protective material can be placed between the downturned lip 25 and the front wall 27 to protect the surface of the bathtub 11′, 11″.

The downturned lip 25 overlying the front wall 27 facilitates access into the bathing fixture 10 by allowing users to first sit on the lip 25 and then bring their legs over the front wall 27 and into the bathtub. This feature is especially useful for users transferring from a wheelchair to the seat assembly 12.

A stabilizing bar 29′, 29″ extends along a portion of the second side edge 15 in a lateral direction, which extends between the first 14 and second 15 side edges. In conjunction with the first side edge 14 and the downturned lip 25, the stabilizing bar 29′, 29″ transfers the weight of the user and the seat assembly 12 to the bathtub 11′, 11″. The stabilizing bar 29′, 29″ extends into and is supported by a receptacle 30′, 30″, 30‴ which opens toward the front wall 27 and which is disposed in the back wall 31 of the bathtub at an elevation substantially corresponding to that of the upper edge 26 of the front wall 27.

Figure 2:
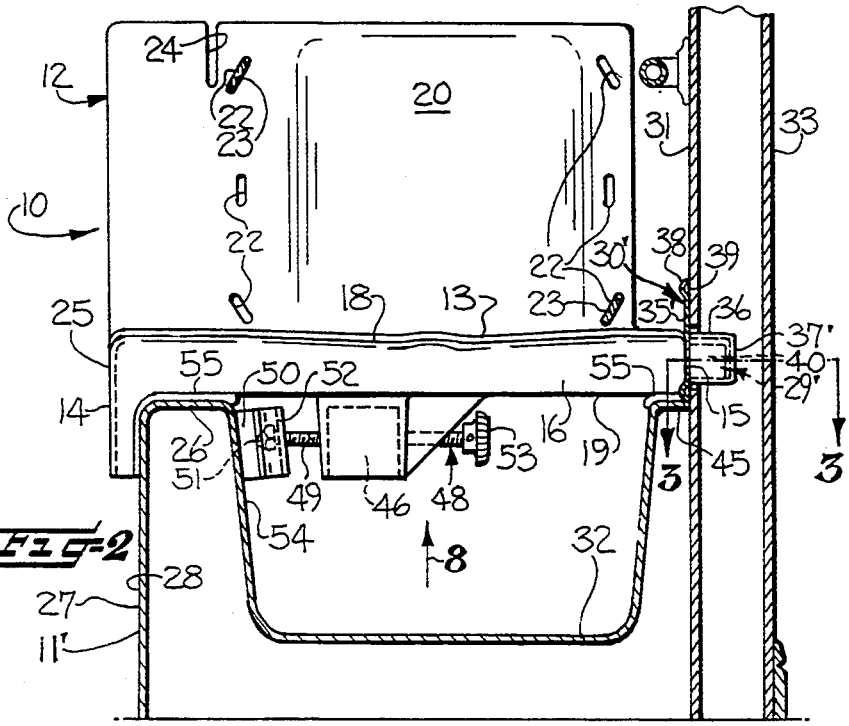
FIG. 2 is a sectioned end view of a bathtub as viewed along direction line 2 of FIG. 1, illustrating the seat assembly of the present invention installed therein.
Figure 15:
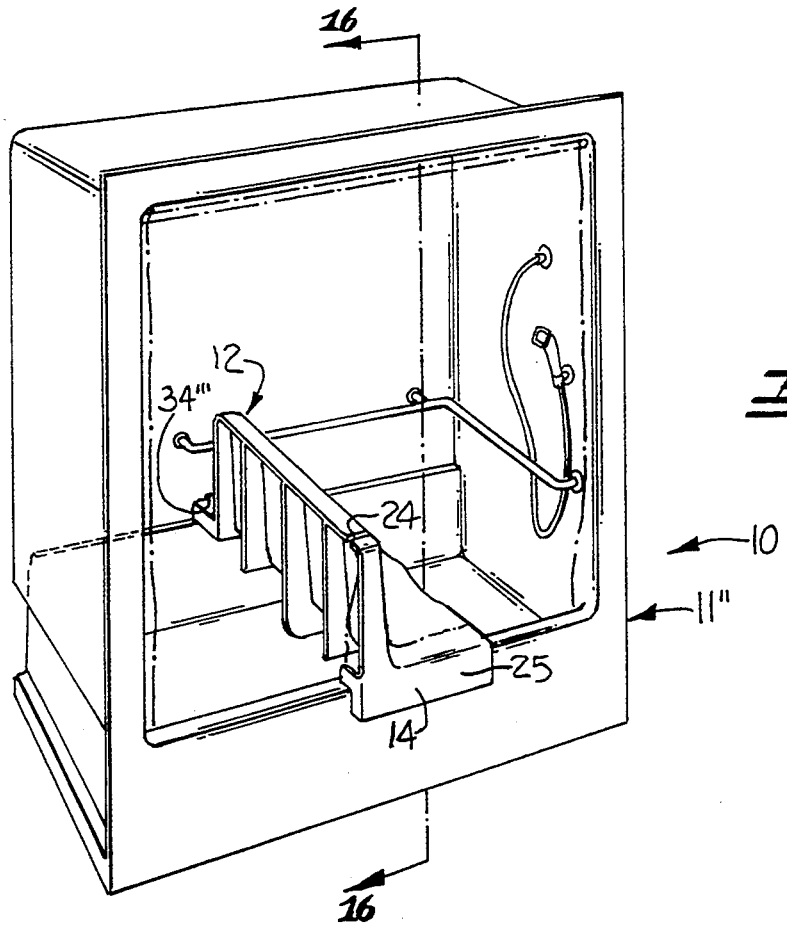
FIG. 15 is a perspective view of the seat assembly as installed in a unitary fiberglass or acrylic bathtub.
Figure 16:
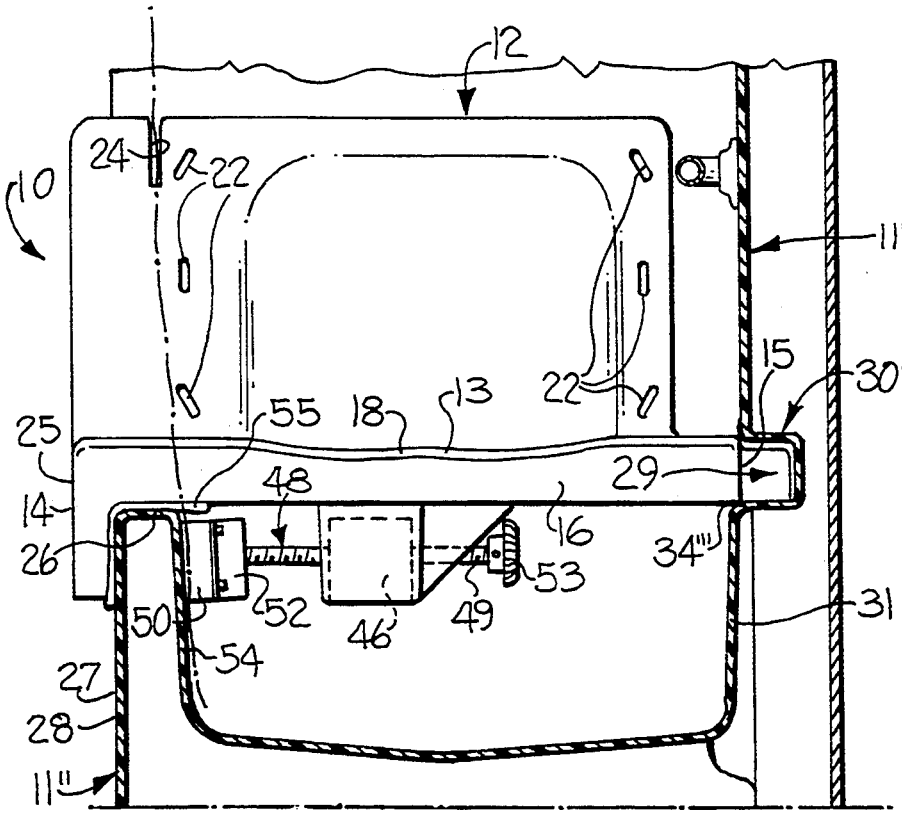
FIG. 16 is a sectioned end view of a unitary bathtub illustrating the molded construction of the receptacle.

The present invention can be used with conventional steel or cast iron bathtubs or with modern fiberglass or acrylic bathtubs. Conventional bathtubs, of the type illustrated as 11′ in FIGS. 1 and 2, have a steel or cast iron tub base 32 that is placed against one of the structural walls 33 of the bathroom. The structural wall 33 is waterproofed, such as with ceramic tiles, and forms a back wall for the bathtub 11′. Modern bathtubs, of the type illustrated as 11″ in FIGS. 15 and 16, are a unitary structure formed from one piece of fiberglass or acrylic.

In conventional bathtubs 11′, the present invention uses one of two embodiments of receptacles, indicated as 30′ and 30″ in the Figures, that are made from a strong and non-corrosive material, such as stainless steel, and which are securely mounted in the structural wall 33 forming the back wall 31 of the bathtub.

Figure 3:
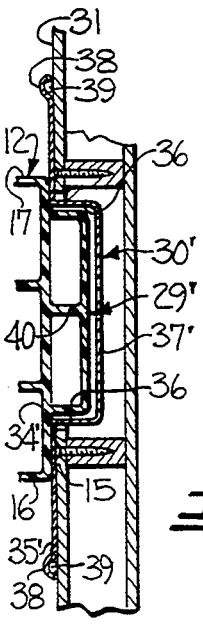
FIG. 3 is a sectioned view of the first embodiment of the stabilizing bar and receptacle as taken along line 3—3 of FIG. 2.
Figure 4:
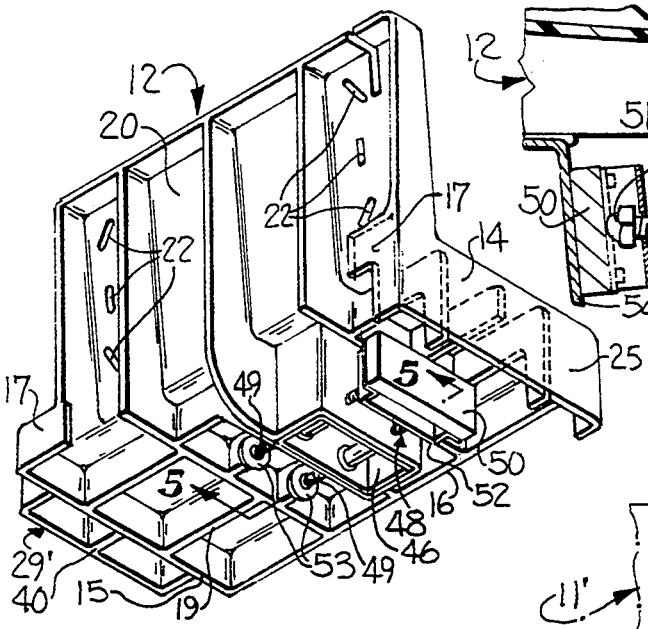
FIG. 4 is a perspective view of the bottom surface of the seat assembly.

The first preferred embodiment includes a receptacle 30′ having an elongate continuous slot 34′ which extends along a longitudinal direction between the front 16 and rear 17 edges of the support portion, as illustrated in FIGS. 3 and 9. The receptacle 30′ has a face plate 35′ which is securely mounted to the back wall 31 of the tub and the slot 34′ extends from the face plate 35′ into the back wall. The slot 34′ has four side walls 36 and an end wall 37′ that are continuously joined to each other and to the face plate 35′ along their edges so as to prevent water from leaking into the back wall 31 through the slot 34′. In addition, the face plate 35′ includes a groove 38 around its back face for seating a seal 39 against the back wall 31. The stabilizing bar 29′ includes an elongate plate-like member 40 which extends into the slot 34′ in the lateral direction and along a portion of the length of the slot 34′ in the longitudinal direction. It will be noted as shown in the drawings, particularly FIGS. 1 to 3 and 9 that the opening or slot 34′ in the receptacle 30′ has approximately the same size as the end member 40 of the stabilizing bar 29′ positioned therein. This close interfitting and cooperating relation prevents the seat assembly from tilting and shifting so as to prevent possible injury to the bather. The mounting means connected to the underside of the seat for mounting and securing the seat to the tub further serves to stabilize the seat and to prevent movement thereof.

In a second preferred embodiment, the receptacle 30″ includes three evenly spaced apart openings 41 formed in the face plate 35″ of the receptacle 30″ and which extend along the longitudinal direction, as illustrated in FIGS. 10–13. Extending into the back wall 31 from each opening 41 is a cylinder 42 which is capped with an end wall 37″. As with the first embodiment, each of the edges of the cylinder 42 and end wall 37″ are continuously joined to the face plate 35″ and each other and a seal 39 is seated against the back wall 31 in a groove 38 on the back of the face plate 35″ to block the passage of water. The stabilizing bar 29″ includes three cylindrical stud-like members 43 which are positioned in the respective openings 41 of the receptacle 30''. As best shown in FIGS. 10 to 13, in this form of the invention the stud-like members 43 of the stabilizing bar have approximately the same size as the respective cylindrical openings 41 in which they are received. This close interfitting and cooperating relation, as in the first embodiment, prevents the seat assembly from tilting and shifting so as to prevent possible injury to a bather.

As shown in FIGS. 11–13, the second embodiment allows the receptacle 30'' to be mounted such that a cylinder 42 can be placed on either side of a stud 44 in the structural back wall 33. This arrangement provides considerable flexibility when installing the receptacle 30'' as to the longitudinal position of the seat assembly 12 within the bathtub 11'.

The present invention can also be used in conventional bathtubs without a receptacle. The stabilizing bar 29', 29'' or second side edge of the horizontal support portion 13 is supported by an upward facing surface 45, present in most conventional bathtubs, that forms the upper edge of the back of the tub base 32. This support surface 45 is disposed in the back wall 31 at an elevation substantially corresponding to that of the upper edge 26 of the front wall.

The present invention can also be used in modern unitary bathtubs 11'', as shown in FIGS. 15 and 16. The receptacle 30''' in such bathtubs 11'' includes an elongate slot 34''' and is molded into the back wall of the bathtub 11'' when the tub is manufactured.

Figure 5:
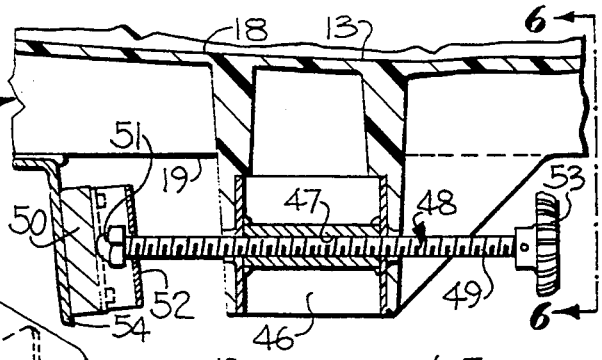
FIG. 5 is a sectioned view of the housing and elongate plunger of the present invention taken along line 5—5 of FIG. 4.
Figure 8:
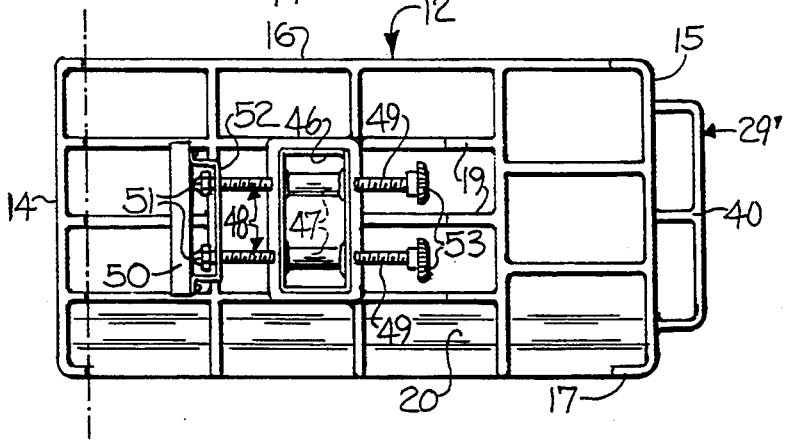
FIG. 8 is a bottom view of the first embodiment of the seat assembly looking in the direction of arrow 8 in FIG. 2.

A housing 46 is mounted to the bottom surface 19 of the seat assembly 12 and includes two parallel threaded through bores 47 extending in the lateral direction, as shown in FIGS. 5, 8 and 10. The threaded through bores 47 are formed of strong and non-corrosive material, such as stainless steel, and are securely mounted in the housing 46. The through bores 47 support two elongate plungers 48 which include a threaded rod 49 threadedly engaged in the respective threaded bore. A pad 50 is mounted to the end of both threaded rods 49 adjacent the first side edge 14 of the seat assembly. A cap nut 51 is secured to the end of each threaded rod 49, as illustrated in FIG. 14, and a retaining plate 52 is affixed to the back side of the pad 50 to retain the pad on the threaded rods, as illustrated in FIGS. 5, 8 and 10.

Figure 6:
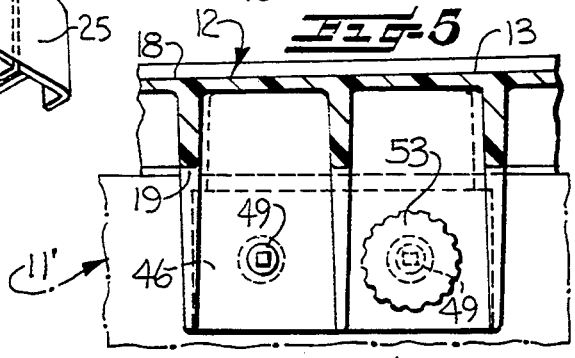
FIG. 6 is a sectioned view of the seat assembly taken along line 6—6 of FIG. 5 and illustrating an end view of the plungers.
Figure 7:
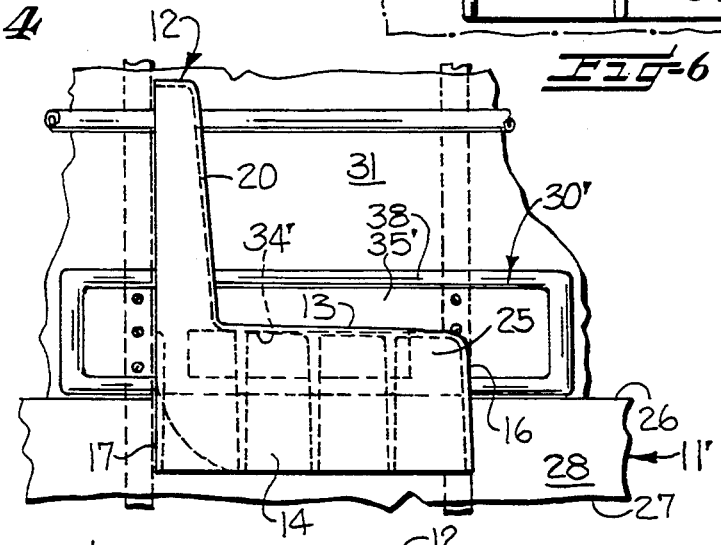
FIG. 7 is a side view of the seat assembly as installed in a bathtub looking in the direction of arrow 7 in FIG. 1.

Hand wheels 53 are attached to the ends of the threaded rods 49 adjacent the back wall 31 of the bathtub, as shown in FIGS. 5 and 6, so as to permit selective movement of the plungers 48 and lateral engagement of the pad 50 with the inner surface 54 of the front wall 27 of the bathtub. The cap nut 51 and retaining plate 52 allow the pad 50 to pivot at the end of the plungers 48 so that, when advanced, the pad 50 will seat squarely against the inner surface 54 of the front wall of most bathtubs. The pad 50 is made from a relatively soft and non-corrosive material, such as plastic or plastic-coated wood, so that it will not damage the bathtub 11', 11''. The inner surface 54 of modern unitary bathtubs 11'' may be formed with a depression (not shown) therein to accommodate the pad 50.

The seat assembly 12 can be securely fastened to the bathtub 11 by one or both of two engagements, depending on the width of the bathtub. In the first, the plungers 48 are advanced until the downturned lip 25 engages the outer surface 28 of the front wall. The front wall 27 of the bathtub 11', 11'' will therefore be gripped between the lip 25 and the pad 50.

In the second engagement, the plungers 48 are advanced until the second side edge 15 of the seat assembly 12 is engaged with the vertical abutment surface of the face plate 35 of the receptacle in conventional bathtubs 11' or the vertical abutment surface of the back wall 31 in modern unitary bathtubs 11''. Alternatively, as would be readily apparent to one of ordinary skill in the art, if the depth of the receptacle 30 is less than the length of the stabilizing bar 29, the end of the stabilizing bar 29 will be held in engagement with the vertical abutment surface of the end wall 37 of the receptacle in conventional 11' and modern unitary 11'' bathtubs. For conventional bathtubs 11' without receptacles, the end of the stabilizing bar 29 will be held in engagement with the vertical abutment surface of the back wall 31 of the bathtub 11'.

In the drawings and specification, preferred embodiments of the invention have been illustrated and described, and although specific terms are employed, they are used in a generic and descriptive sense and not for purposes of limitation.

That which is claimed is:

1. A bathing fixture comprising a bathtub including a relatively low front wall which defines a horizontal upper edge, an opposite back wall which is spaced from said front wall, and a receptacle in said back wall having at least one opening therein which opens toward said front wall and which is disposed at an elevation which substantially corresponds to that of said upper edge, and a seat assembly comprising, (a) a horizontal support portion which includes opposite first and second side edges, opposite front and rear edges, an upper surface, and a bottom surface, (b) a housing mounted to said bottom surface of said seat assembly, (c) elongate plunger means including pad means mounted to one end thereof, (d) means mounting said plunger means to said housing so that said plunger means extends in a lateral direction which extends between said side edges with said pad means positioned adjacent said first side edge of said support portion, and so as to permit selective movement of said plunger means in the lateral direction, and (e) stabilizing bar means at said second side edge and extending in the lateral direction, said seat assembly being mounted to said bathtub with said first side edge of said support portion resting upon said upper edge of said front wall of said bathtub, with said pad means of said plunger means laterally engaging said front wall of said bathtub, and with said stabilizing bar means extending into said opening of said receptacle in said back wall of said bathtub, and wherein said opening and said stabilizing bar means are closely interfitting and have approximately the same size and cooperate with each other to prevent the seat assembly from tilting and shifting so as to prevent possible injury to a bather.

2. The bathing fixture as defined in claim 1 wherein said front wall of said bathtub includes an inner surface facing said back wall and an oppositely facing outer surface, with said upper edge joined between said inner and outer surfaces, and wherein said support portion of said seat assembly includes a downturned lip which engages said outer surface, and so that said front wall of said bathtub is gripped between said lip and said pad means of said plunger means.

3. The bathing fixture as defined in claim 1 wherein said receptacle has a generally vertical abutment surface positioned so that said stabilizing bar means is held in engagement with said abutment surface by the engagement of said pad means with said front wall.

4. The bathing fixture as defined in claim 1 wherein said seat assembly further comprises an upright backrest portion joined to said rear edge of said support portion.

5. The bathing fixture as defined in claim 4 further comprising belt means joined to said seat assembly for supporting a user in a seated position thereon.

6. The bathing fixture as defined in claim 1 wherein said means mounting said plunger means to said housing comprises a laterally directed threaded through bore in said housing, and said plunger means comprises a threaded rod which is threadedly engaged in said threaded bore.

7. The bathing fixture as defined in claim 1 wherein said opening in said receptacle in said back wall of said bathtub comprises an elongate continuous slot which extends along a longitudinal direction extending between said front and rear edges of said support portion, and wherein said stabilizing bar means comprises an elongate plate-like member which extends within said slot.

8. The bathing fixture as defined in claim 1 wherein said receptacle in said back wall of said bathtub has a plurality of separate openings which extend along a longitudinal direction extending between said front and rear edges of said support portion, and wherein said stabilizing bar means comprises a plurality of stud-like members which are positioned in respective ones of said openings.

9. A bathing fixture comprising a bathtub including a relatively low front wall which defines a horizontal upper edge, an opposite back wall which is spaced from said front wall, and a receptacle in said back wall having at least one opening therein which opens toward said front wall and which is disposed at an elevation which substantially corresponds to that of said horizontal upper edge, an elongate seat comprising a horizontal support portion having an outer end portion resting on said front wall of said tub and an inner end portion terminating along the back wall of the tub, stabilizing bar means extending outwardly horizontally from said inner end portion of said seat and into said opening of said receptacle in said back wall of said tub, and wherein said opening and said stabilizing bar means are closely interfitting and have approximately the same size and cooperate with each other to prevent the seat assembly from tilting and shifting so as to prevent possible injury to a bather, and means connected to the underside of said seat and engaging said tub for mounting said seat to said tub and for releasably maintaining said stabilizing bar in interfitting and cooperating relation to said receptacle in the back wall of the tub.

* * * * *